US011167827B2

(12) United States Patent
McCaughan et al.

(10) Patent No.: US 11,167,827 B2
(45) Date of Patent: Nov. 9, 2021

(54) SURVIVAL CRAFT

(71) Applicant: Survitec Group Limited, Merseyside (GB)

(72) Inventors: Duncan McCaughan, Lisburn (GB); Michael Luck, Seesen (DE)

(73) Assignee: Survitec Group Limited, Merseyside (GB)

( * ) Notice: Subject to any disclaimer, the term of this patent is extended or adjusted under 35 U.S.C. 154(b) by 639 days.

(21) Appl. No.: 15/999,849

(22) PCT Filed: Feb. 17, 2017

(86) PCT No.: PCT/EP2017/053693
§ 371 (c)(1),
(2) Date: Aug. 20, 2018

(87) PCT Pub. No.: WO2017/140890
PCT Pub. Date: Aug. 24, 2017

(65) Prior Publication Data

US 2021/0214060 A1 Jul. 15, 2021

(30) Foreign Application Priority Data

Feb. 18, 2016 (GB) ..... 1602866

(51) Int. Cl.
*B63C 9/04* (2006.01)
*B63B 7/08* (2020.01)
*B63H 20/00* (2006.01)

(52) U.S. Cl.
CPC ..... *B63C 9/04* (2013.01); *B63B 7/087* (2013.01); *B63C 2009/042* (2013.01); *B63C 2009/044* (2013.01); *B63H 20/007* (2013.01)

(58) Field of Classification Search
CPC .... B63C 9/00; B63C 9/04; B63C 9/08; B63B 7/00; B63B 7/087; B63B 23/00;
(Continued)

(56) References Cited

U.S. PATENT DOCUMENTS 2,698,447 A 1/1955 Potts et al.
3,268,925 A * 8/1966 Serra ..... B63C 9/04 441/40

(Continued)

FOREIGN PATENT DOCUMENTS

DE 2017747 A1 1/1972
EP 0720945 A1 7/1996

(Continued)

OTHER PUBLICATIONS

UK Search Report dated Jul. 12, 2016, in Priority UK Application No. GB 1602866.4, 4 pages.

(Continued)

*Primary Examiner* — Lars A Olson
(74) *Attorney, Agent, or Firm* — Maschoff Brennan

(57) ABSTRACT

This invention relates to a survival craft comprising a hull (10) formed from inflatable members, an optional canopy support structure carried by the hull and formed from inflatable members, and an inflatable wall structure (11). The invention also relates to rigid pod (19) configured to carry a survival craft in a deflated state and be coupled to the hull when the craft is in an inflated state. The inflatable parts may be formed from drop thread material.

7 Claims, 15 Drawing Sheets

(58) Field of Classification Search
CPC ..... B63B 2009/042; B63B 2009/044; B63B 7/04; B63H 20/007
USPC ..... 441/40, 41, 42; 114/345
See application file for complete search history.

(56) References Cited

U.S. PATENT DOCUMENTS

| | | | | |
|---|---|---|---|---|
| 4,180,882 | A | 1/1980 | Motojiro | |
| 4,911,094 | A * | 3/1990 | Akers | B63B 1/041 441/40 |
| 6,209,476 | B1 * | 4/2001 | Maurel | B63B 7/08 441/40 |
| 6,685,520 | B1 * | 2/2004 | Wiggins | B63C 9/04 441/40 |
| 2014/0283729 | A1 | 9/2014 | Christian et al. | |

FOREIGN PATENT DOCUMENTS

| | | | |
|---|---|---|---|
| EP | 2684794 | A1 | 1/2014 |
| GB | 940247 | A | 10/1963 |
| JP | S52167793 | U | 12/1977 |
| WO | 2002/066321 | A1 | 2/2002 |
| WO | 2015107019 | A1 | 7/2015 |

OTHER PUBLICATIONS

International Search Report dated May 16, 2017 in related PCT Application No. PCT/EP2017/053693.
Examination letter from the European Patent Office dated Nov. 21, 2019 regarding European Application No. 17705887.2.

* cited by examiner

SURVIVAL CRAFT

TECHNICAL FIELD

The invention relates to survival craft comprising a hull formed from inflatable members. The invention also relates to rigid pod configured to carry, in a deflated state, a survival craft.

BACKGROUND TO THE INVENTION

A known form of survival craft is a lifeboat for use on a marine structure such as an offshore oil rig or a ship comprises a conventional rigid hull carrying a protective shelter and is mounted on the structure by davits from which, after loading with people, it can be lowered into the water. The lifeboat may be provided with an engine to allow it to propel itself away from the structure after entering the water.

The provision of rigid lifeboats and the associated davits occupy significant space on marine structures. This is a particular problem on passenger ships such as cruise ships where the space taken by the lifeboats and davits reduces the number cabins available with side views.

SUMMARY OF THE INVENTION

According to a first aspect of the invention, there is provided a survival craft including inflatable members, the survival craft comprising a hull formed from the inflatable members and an inflatable wall formed from the inflatable members for mounting a rigid pod to the hull.

At least one of the inflatable members may be formed from a drop thread material. This may provide additional strength and rigidity to the craft.

The survival craft may include a canopy support structure carried by the hull and formed from the inflatable members.

In this way, the craft can be stored on the marine structure in deflated form in a compact manner and, when deployed and inflated provide both the ability to carry people and the ability to move clear of the structure under its own propulsion.

Preferably, the floor of the craft is formed by a plurality of modular inflatable chambers. These modular inflatable chambers can be placed in a cross laid arrangement and/or multiple layers. Advantageously, this forms a smooth surface for passengers on the craft whilst providing increased rigidity to the craft and allows damaged modular inflatable chambers to be easily replaced if damaged.

Preferably, the hull includes a number of inflatable tubes along the floor of craft which provides the craft with a spine and stiffener support structure that advantageously improves rigidity of the craft.

Preferably, the inflatable members of the hull comprise inflatable tubes or vertical inflatable panels. Advantageously, the vertical inflatable panels are formed by a plurality of modular inflatable chambers which allows damaged modular inflatable chambers to be easily replaced is damaged.

Preferably the canopy support structure of the craft is formed by a network of elongate inflatable tubes which forms a roof structure for the craft and supports a canopy.

The under surface of the hull preferably includes inflatable sleeves that define a space of triangular cross section to retain water. Advantageously, the additional weight added to the craft by the water retained in the sleeves improves the overall stability of the craft during use.

Preferably, the craft enables an inclined or vertical passenger transfer system to be attached to the craft (e.g. once inflated). This provides a safer method of boarding the craft as opposed to lowering a craft full of passengers into the sea or water. The inclined transfer system may include a transfer platform or the transfer may be direct to the craft. The vertical transfer system may be directly into the craft, or may be via a transfer platform.

Preferably, when the hull of the craft is formed of vertical inflatable panels, the hull includes an opening and a door for assisting persons to board the craft from the water.

Preferably, when the craft is deflated, the rigid pod carries (e.g. on an exterior surface of the pod) the hull, the canopy support structure and the wall. Advantageously, the compact state of the deflated craft minimises the storage space needed by any marine structure.

Once inflated, the pod may be securely attached to the wall by a fastening means and/or an interference fit to ensure the inflated members of the craft and the pod are not separated.

Preferably, the pod carries a powered propulsion unit which can be lowered into the sea once the survival craft is deployed. The pod also carries the energy source for the propulsion unit. Advantageously, this enables the craft to operate independently and without any external power source. Having the propulsion units lowered once the craft is deployed also prevents damage to any part of the propulsion unit.

Other aspects of the invention are defined in the claims.

BRIEF DESCRIPTION OF THE DRAWINGS

For a better understanding of the present invention embodiments will now be described by way of example, with reference to the accompanying drawings, in which.

In the drawings, like elements are generally designated with the same reference sign.

DETAILED DESCRIPTION OF EMBODIMENT OF THE INVENTION

Figure 1:
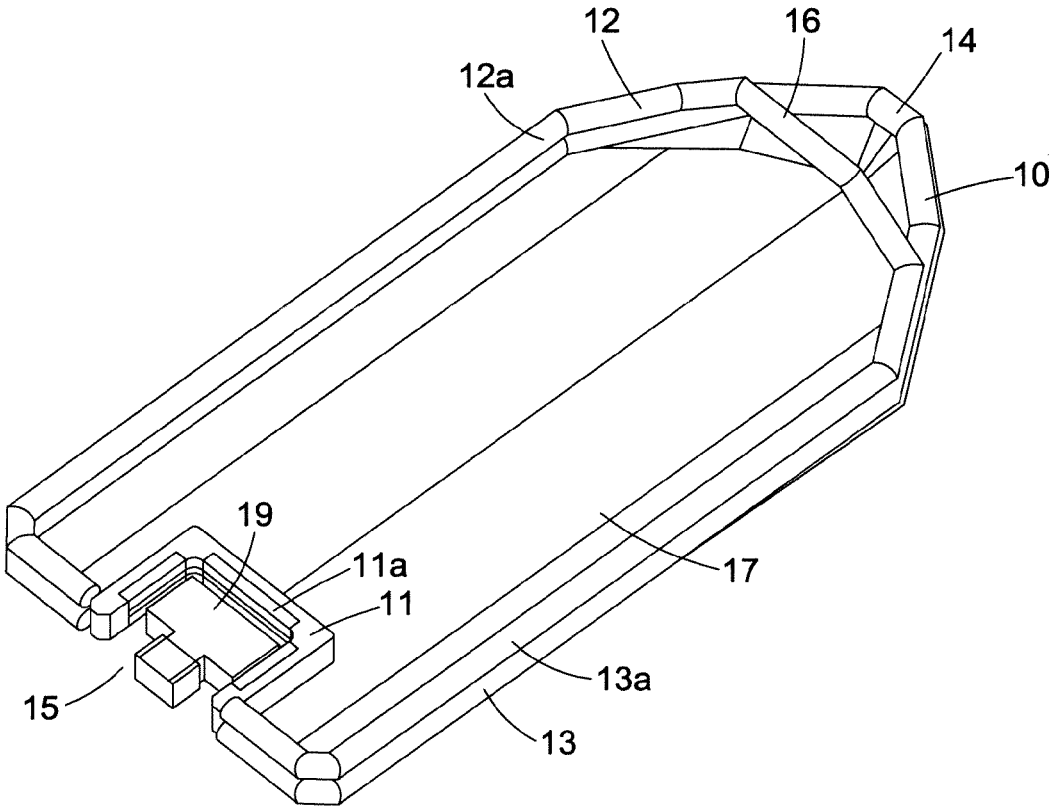
FIG. 1 is a perspective view of the survival craft showing the hull and the pod attached thereto.
Figure 2:
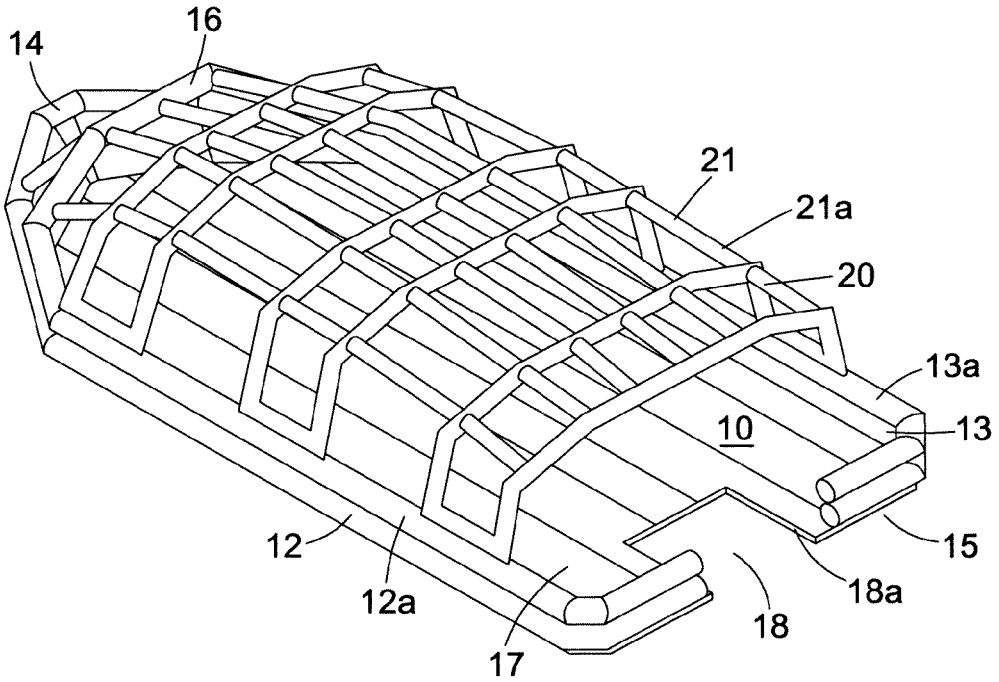
FIG. 2 is a perspective view of the survival craft illustrating the canopy support structure carried by the hull.

Referring first to FIGS. 1 and 2 the survival craft comprises a hull 10, a canopy support structure 20 carried on the hull 10 and a wall 11. The craft may have a capacity of e.g. from 25 to over 400 persons.

The hull 10 is formed by first port and starboard inflatable tubes 12, 13 that extend along the gunwales of the hull 10 and extend upwardly while converging to meet at a shaped bow 14, and second port and starboard inflatable tubes 12*a*, 13*a* that extend along the first port and starboard inflatable tubes extending upwardly while converging to form an archtube 16. The first and second port and starboard inflatable tubes 12, 13, 12*a*, 13*a* may also extend along the stern 15 leaving an opening 18.

A floor 17 extends between the tubes 12, 13, 12*a*, 13*a* and is formed by spaced sheets of air-impervious fabric forming an inflatable chamber. The spaced sheets may be formed by a drop thread material which provides an inherent strength. The floor advantageously provides a smooth flat surface for the passengers. The air gap between the sheets of air-impervious fabric also provides thermal insulation.

The floor 17 has a rectangular recess 18*a* formed therein at the stern end thereof to provide an opening 18.

Figure 3:
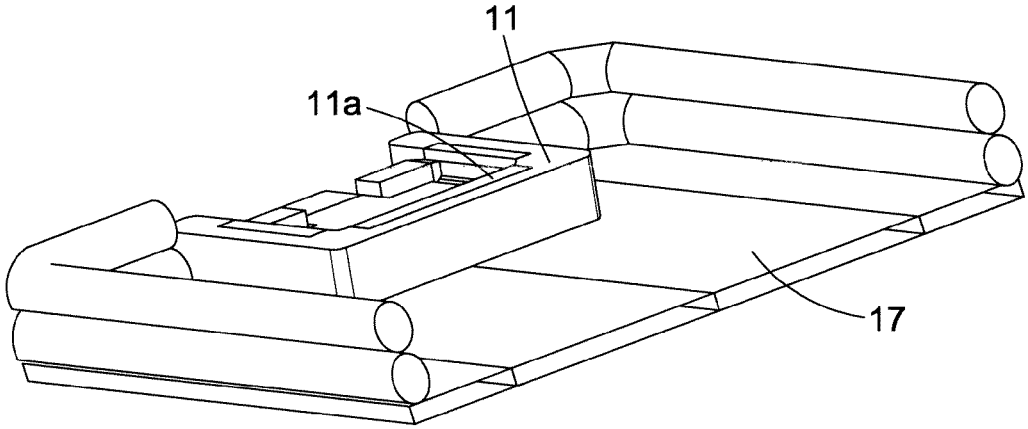
FIG. 3 is a cross sectional view of the survival craft focusing on the rear of the craft.

As seen in FIG. 3, the hull 10 comprises a U-shaped wall 11 that surrounds the recess 18*a* at the stern 15. The wall 11 is formed by an inflatable chamber coupled to the floor 17 of the craft and may be formed using a drop thread material. The inflatable chamber may be a circular tube or vertical flat sheet panels. The wall 11 may rest on the upper surface of the floor 17 or may abut the edges of the floor 17 that define the opening 18. The wall 11 may be bonded to the floor 17.

The wall 11, when inflated, acts as a bund and an extension to the gunwale formed by the tubes, 12, 13, 12*a*, 13*a*. The wall 11 may be bonded to the tubes 12, 13, 12*a*, 13*a* to provide a water-tight barrier. The wall 11 may abut the tubes 12, 13, 12*a*, 13*a* to provide a water-resistant barrier.

Figure 4:
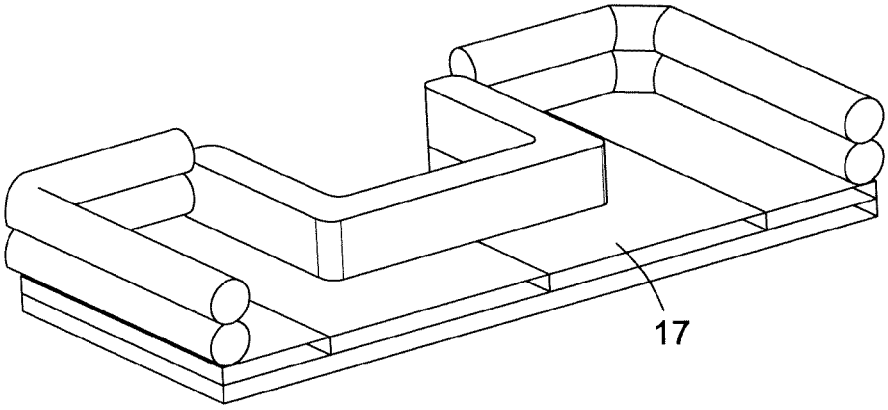
FIG. 4 is a similar view to FIG. 3 showing an alternative arrangement of the modular floor.

As seen in FIGS. 3 and 4, the floor 17 may be formed by modular inflatable chamber portions. Each inflatable chamber portion is preferably isolated from the other inflatable chamber portions after inflation, so that, if one inflatable chamber portion is damaged, the intact inflatable chamber portions are sufficient to provide a functional floor 17. This also allows replacement of damaged inflatable chamber portions.

As also seen in FIGS. 3 and 4, the floor 17 may be formed by two layers, one lying on top of the other. More than two layers may be provided. Each layer may comprise a plurality of the modular inflatable chamber portions. The modular inflatable chamber portions of adjacent layers may be in a staggered arrangement or any other arrangement so that one or mere edges of the inflatable chamber portions are not aligned in adjacent layers (e.g. the portions are in a cross laid arrangement). This may provide additional stiffness to the craft.

Figure 5:
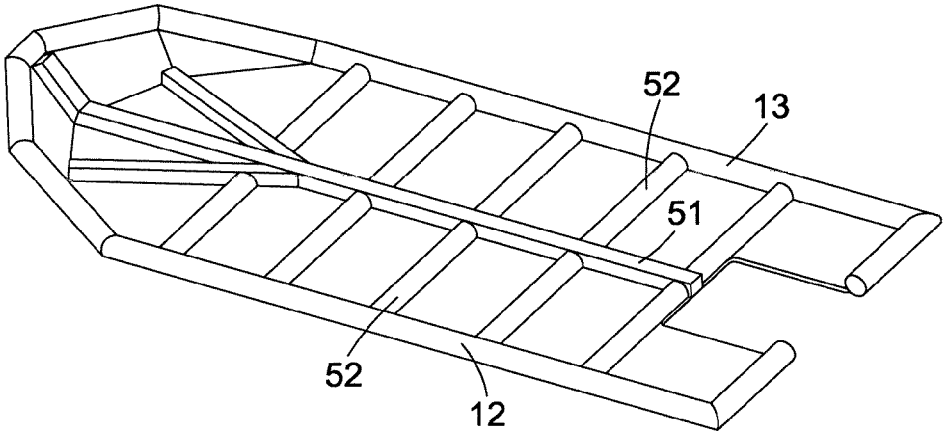
FIG. 5 is a perspective view showing a spine and stiffener structure along the floor of the craft.

As shown in FIG. 5, a longitudinal floor tube 51 may extend from the wall 11 to the bow 14 along the floor 17 to form a central spine of the craft and additional floor tubes 52 extending (e.g. perpendicularly) from the spine to tubes 12, 13 may be used as stiffeners to increase rigidity of the structure. These tubes 51, 52 may also be formed of a drop thread material. The tubes 51, 52 may be inflatable.

Figure 6:
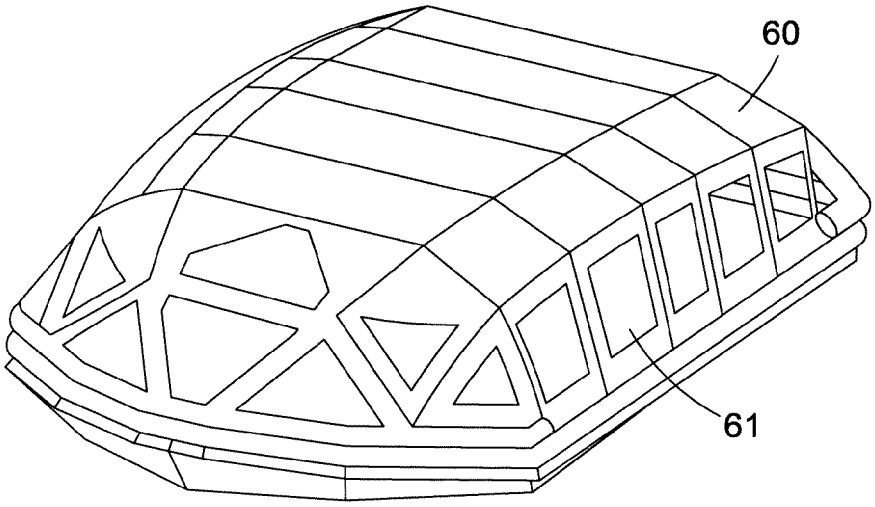
FIG. 6 illustrates the canopy support structure supporting a flexible material covering the craft.

The canopy structure 20 is formed by a network of elongate inflatable tubes 21, 21A arrangement along the length of the hull and supported by the archtube 16. The network of inflatable tubes comprises a series of (e.g. six) spaced apart longitudinal tubes and a series of (e.g. six) transverse tubes 21A. The tubes 21 and 21A are interconnected. The tubes 21 and 21A may have a generally arched shape. A sheet 60 of flexible water-impervious material over the archtube 16 and canopy structure 20 to a canopy, as shown in FIG. 6. The generally arched shape of the tubes 21 and 21A holds the sheet 60 apart from the floor 17 to define a passenger space that is protected from the elements. Again, any or all of the tubes may be made from a drop thread material.

In this way, the canopy support 20 forms a truss structure carried by and is supported by the hull 10 that provides the hull 10 with increased rigidity, resisting any tendency of the hull 10 to bow. In addition, it forms a protective shelter for occupants of the survival craft.

A sheet 60 of flexible water-impervious material covers the sides of and the ends of the canopy structure 20 and is provided with door and window openings 61.

Figure 7:
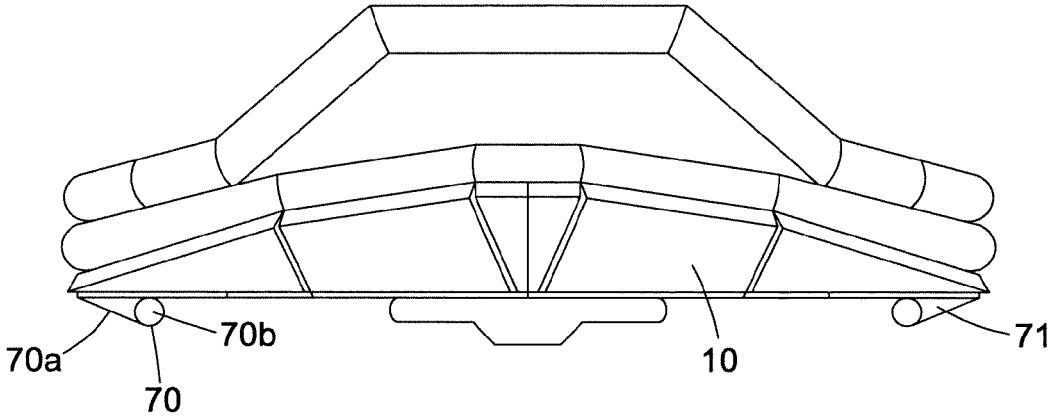
FIG. 7 is a front elevational view from the front of the craft showing the sleeves attached to the underside of the hull.

As seen in FIG. 7, longitudinally extending sleeves 70 may be fitted towards the outer side edges of the under surface of the hull 10. The sleeves 70 comprise a sheet of flexible material 70A that is connected at one end to an outer side edges of the under surface of the hull 10. At the other end, the sheet of flexible material 70A is connected to a first side of an inflatable tube 70B. The inflatable tube 70B extends longitudinally and is bonded at a second side, opposite to the first side, to the under surface of the hull 10. Once the inflatable tubes 70B are inflated, the sleeves 70 define a space of substantially triangular cross section 71 which retains water to add weight to the craft, thereby providing stability.

The survival craft also comprises a rigid pod structure 19 (see e.g. FIGS. 1 and 3). The pod 19 is supported by and securely mounted to the wall 11 by a hinged fabric attachment 11*a* (e.g. by lacing), by bonding and/or by an interference fit between the side walls of the pod 19 and the wall 11. The pod 19 acts as the transom. The pod 19 is an integral component of the craft. The pod structure 19 may be made from a drop thread material, aluminium, glass fibre reinforced plastics (GRP) or steel. The pod 19 structure may float in water.

Figure 11:
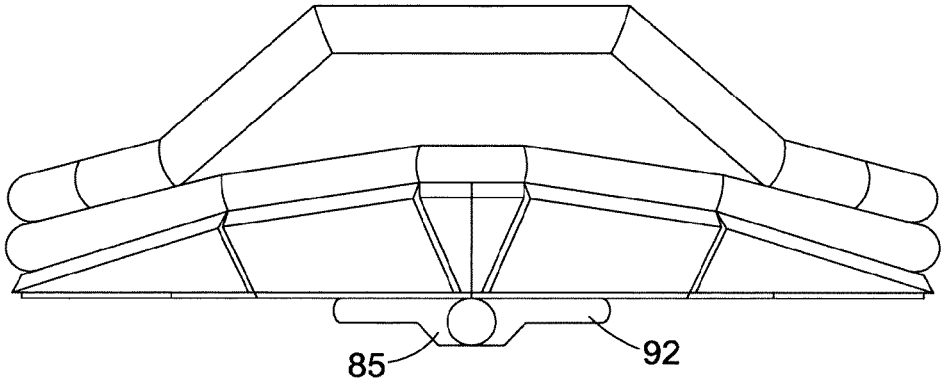
FIG. 11 is a similar view to FIG. 7 showing inflation cylinders arranged on the underside of the hull.

The pod 19 may be formed in a substantially rectangular shape or any other shape complimenting the recess 18*a*. The pod 19 may include an inclined surface 92 to provide hydrodynamic support when attached to the craft and in use. The pod 19 may also include an additional protruding section 104 which acts as a protective fender for the propulsion unit. Additionally, the pod 19 may include a skeg 85 (FIG. 8) which improves the directional stability of the craft and may also have an inclined edge to improve hydrodynamics. FIG. 11 illustrates the craft once the pod is attached.

Figure 8:
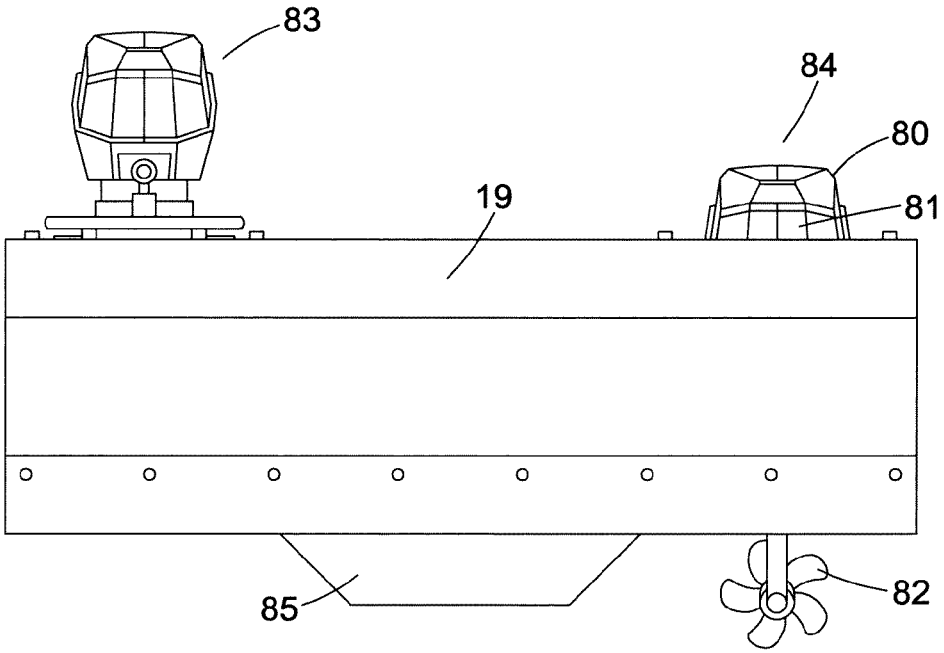
FIG. 8 is front elevational view of the pod front the front, showing the power units in a lowered position and a raised position.
Figure 9:
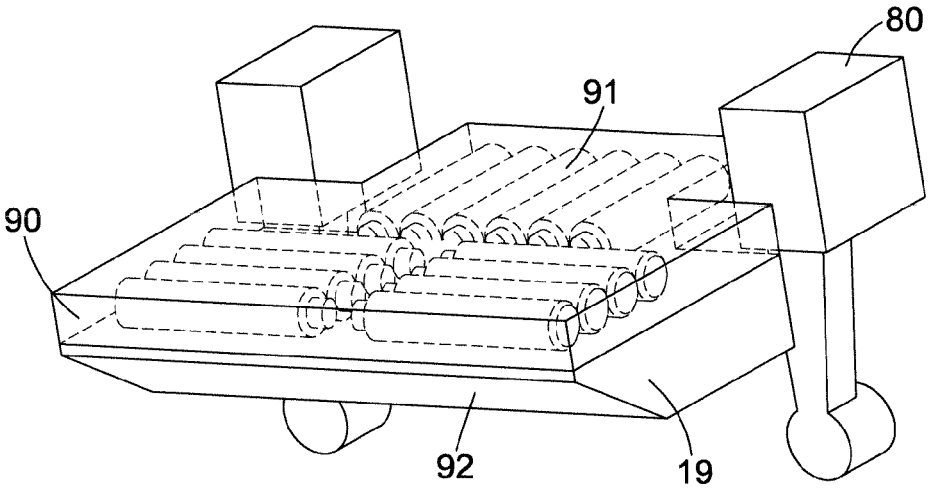
FIG. 9 shows another view of the pod support an inflation tray.
Figure 10:
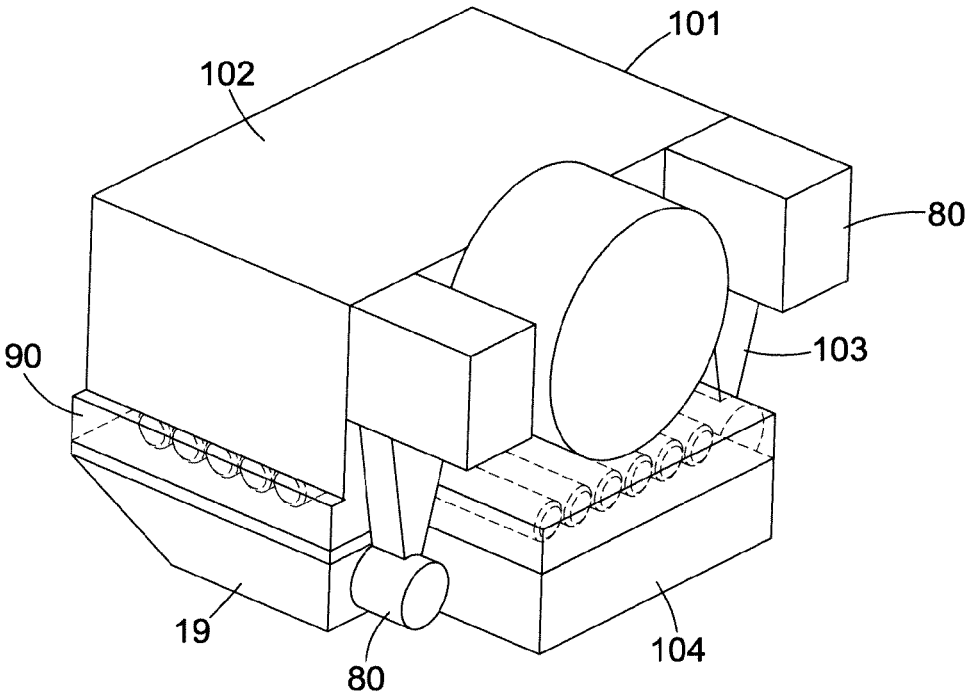
FIG. 10 shows a third perspective view of the pod carrying an inflation tray and an uninflated survival craft.

As shown in FIGS. 8, 9 and 10, a powered propulsion unit 80 for the survival craft is attached to or enclosed within the pod 19. The powered propulsion unit 80 may be motor 81 driving a shielded propeller 82. The craft may be steerable from within the hull 10. The powered propulsion unit may use petrol, diesel, electric or any combination as a fuel source. The pod 19 may also house a starter for the propulsion unit (if applicable) and a battery/cell (if applicable). The pod 19 may also store the fuel source for the propulsion unit 80. Fuel may alternatively (or additionally) be stored within bladders located inside the craft, exterior to the craft, or a combination of both.

As shown in FIG. 8, more than one powered propulsion unit 80 may be attached to the pod 19. The propellers 82 may be replaced by, for example, a water jet.

The powered propulsion unit 80 may be attached to the pod 19 with a lowering mechanism. Thus, when the craft is stored, the propulsion unit 80 may be in a raised position 83 and when in use, lowered into a driving position 84. The lowering mechanism may be automatic or manually controlled.

Additional equipment such as a compressor for back inflation air, an osmosis pump for fresh water, heating units or a ventilation unit as backup air supply may be positioned inside the pod 19 and powered by the powered propulsion unit 80.

Advantageously, the combination of the modular inflatable chambers (of the floor), the inflatable members of the hull and the wall 11, acts a transom to transfer power from the pod 19 to the hull 10 to propel the craft forward.

Referring to FIGS. 9 and 10, the pod 19 carries an inflation system. The inflation system is provided in the form of an inflation tray 90 and is mounted on top of the pod 19. The inflation tray 90 may be formed and manufactured from angular or flat sheet aluminium or steel to provide a rigid frame. The inflation tray 90 may include gas cylinders and hoses 91 for storing gases and for providing gases to the modular inflatable chambers (of the floor), tubes 51, 52 (of the floor), tubes 12, 13, 12*a* and 13*a* (of the hull), and tubes 21, 21A (of the canopy) in order to inflate them. The gases used for the inflation system may be any combination of carbon dioxide, nitrogen, helium and air. In order to allow easy servicing, the inflation tray 90 can be easily separated from the pod.

The pod structure 19 may include a compressor to provide inflation gas instead of the gas cylinders, or in addition thereto.

The pod 19 may include a diagnostic port that allows the status of services (e.g. fuel capacity, battery status, inflation system status) of the survival craft to be checked. A processor may be provided in the pod 19 to record this data and make it available via the diagnostic port. The diagnostic port may be a USB port.

The pod 19 may include a separate container the stores "lifed" items—i.e. items that have a limited useful lifespan. The container may store items such as sea sickness tablets and other medication. The container is readily replaceable, which eases servicing of the survival craft.

The rigid pod 19 may be configured to carry required emergency equipment—e.g. flares first aid kit etc, along with food and water. The pod 19 may be configured to support back up services e.g. a reverse osmosis pump, inflation pumps, etc. The power for the support services may be taken from the propulsion unit 80.

Figure 12:
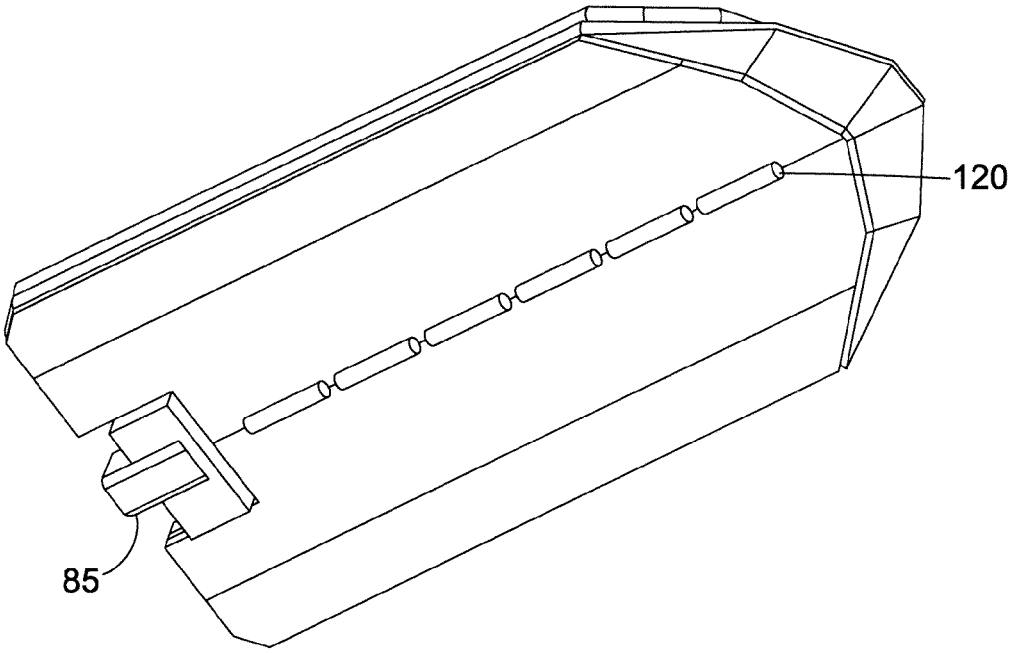
FIG. 12 is another view of FIG. 11 showing the inflation cylinders along the centreline and the pod attached to the craft.
Figure 13:
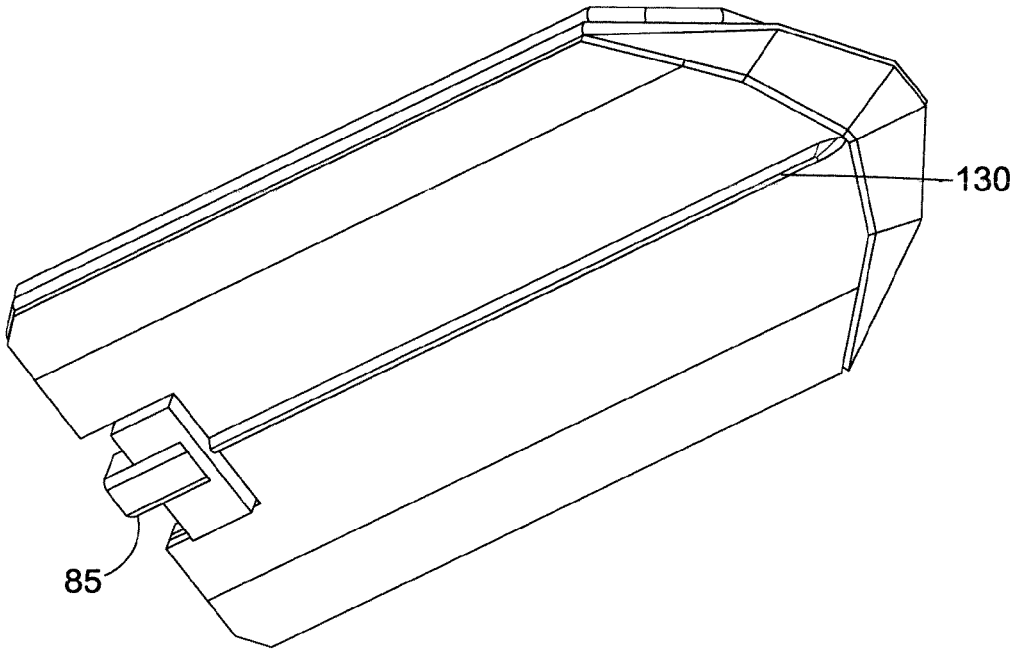
FIG. 13 shows the cylinders of FIGS. 11 and 12 enclosed by a cover.
Figure 14:
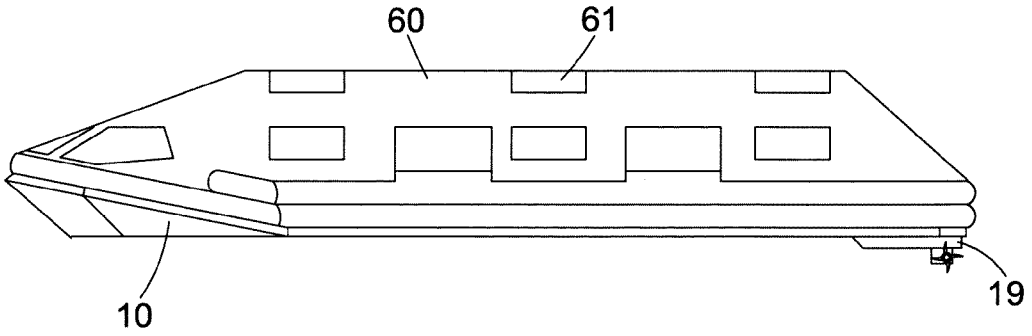
FIG. 14 shows a side view of an inflated survival craft with pod attached thereto.

As seen in FIGS. 12 and 13, in addition to the skeg of the pod 19, or alternatively, inflation cylinders may be mounted along the centreline of the underside of the hull 120 forming a keel. The cylinders may be enclosed within a sleeve arrangement 130 so that they are streamlined. This keel arrangement aids the stability and steering of the craft. The inflation cylinders may be the cylinders held by the inflation tray or external cylinders.

When stored, the inflatable members of the survival craft are deflated and packed into a valise 101 which may be rigid or flexible. The deflated assembly 102 is mounted on top of the inflation tray 90 which may also be removed from the inflation tray to easily allow regular maintenance works and/or servicing. As seen in FIG. 10, in the deflated state, the survival craft comprises the deflated assembly 102, the inflation tray 90 and the pod 19. The deflated assembly 102 may carried by the pod 19 in other ways. The deflated assembly 102 may be attached to an outer surface of the pod 19—e.g. a top, side or bottom surface.

The survival craft in its deflated state may be carried by a deployment system on a marine structure of a known type and when required for use, the system releases the deflated survival craft into the water. On reaching the water, the inflation system commences inflation of the survival craft and the assembly 102 opens, allowing the survival craft to complete inflation and deploy. The inflation may be automatic or manual.

People from the marine structure can then enter the survival craft through an inclined transfer system—e.g. including an evacuation passage (such as a slide), of a known type, which may be attached to the craft by a series of patches mounted on the pod 19 or on the bund 11. The inclined transfer system may include a transfer platform or the transfer may be direct to the craft. The vertical transfer system may be directly into the craft, or may be via a transfer platform. The side may optionally remain attached to the survival craft (or platform) after the passengers have boarded to provide additional passenger space or storage space. Alternatively, vertical evacuation passages of known type may be attached to any location of the craft (or platform) by means of a suitable inflatable frame. In FIG. 10 an evacuation passage 103 is shown positioned above the stern end of the pod 19, for allowing passengers to enter the survival craft. Known types of evacuation passages 103 may include chutes or slides.

It is safer to have people enter a survival craft after it is on the water, rather than lowering a full craft into the sea.

The propulsion system 80 may be used to move the survival craft clear of the structure and to steer it.

The provision of a rigid floor 17 and the inflatable sleeve 70 reduces the tendency of the floor 17 to crease as the hull 10 travels through water so reducing the drag on the hull 10.

Figure 15:
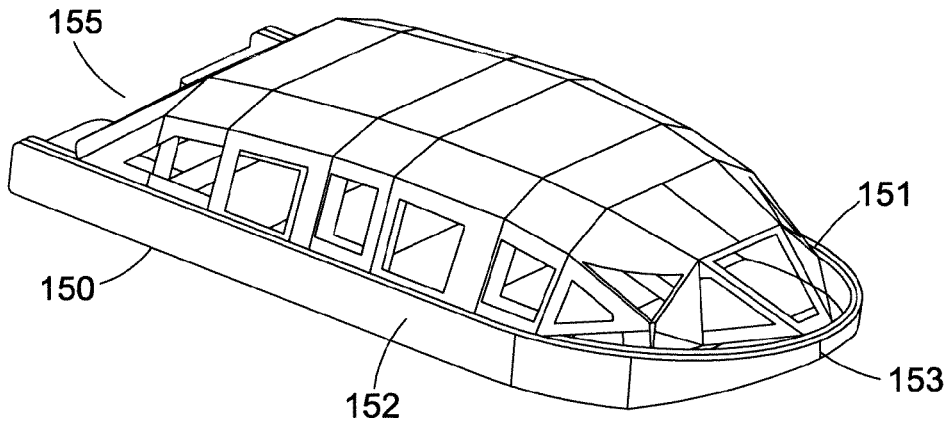
FIG. 15 is a perspective view of an alternative survival craft.
Figure 16:
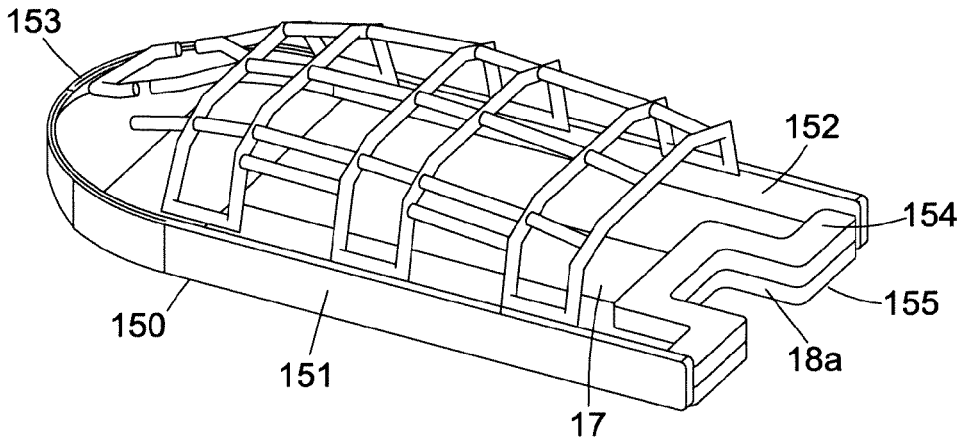
FIG. 16 is a perspective view of the alternate survival craft illustrating the canopy support structure carried by the hull.

FIGS. 15 and 16 show an alternate construction of the survival craft. The inflatable tubes 12, 13, 12*a*, 13*a* that form the periphery of the craft may be replaced by vertical inflatable panels which may be of a drop stitch material. The hull 150 of this craft is formed by port and starboard vertical inflatable panels 151, 152 that extend along the gunwales of the hull while converging to meet at a shaped bow 153.

Figure 17:
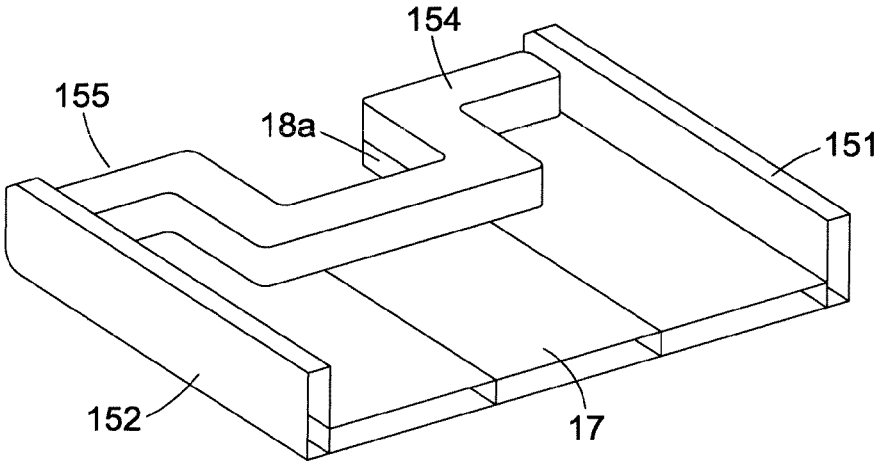
FIG. 17 is a cross sectional view of the survival craft focusing on the rear of the craft.

As seen in FIG. 17, in this embodiment, the stern end 155 of the craft is formed of an inflatable wall 154 extending between the port and starboard vertical inflatable panels 151, 152 and around the recess 18*a* of the floor 17.

Figure 18:
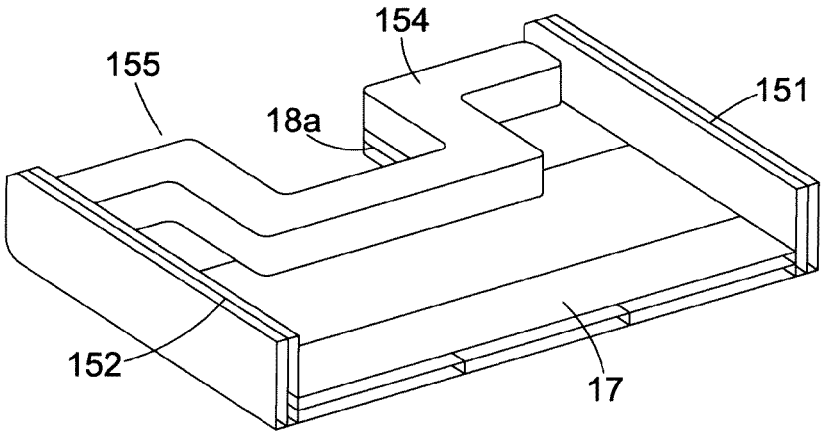
FIG. 18 is a similar view to FIG. 17 showing a modular arrangement of the vertical inflatable panels.

Similar to the construction of the floor 17, the vertical inflatable panels of the craft may also be formed by modular inflatable chamber portions as seen in FIG. 18. Each inflatable chamber portion is preferably isolated from the other inflatable chamber portions after inflation, so that, if one inflatable chamber portion is damaged, the intact inflatable chamber portions are sufficient to provide a functional periphery of the hull. This also allows replacement of damaged inflatable chamber portions.

Figure 19:
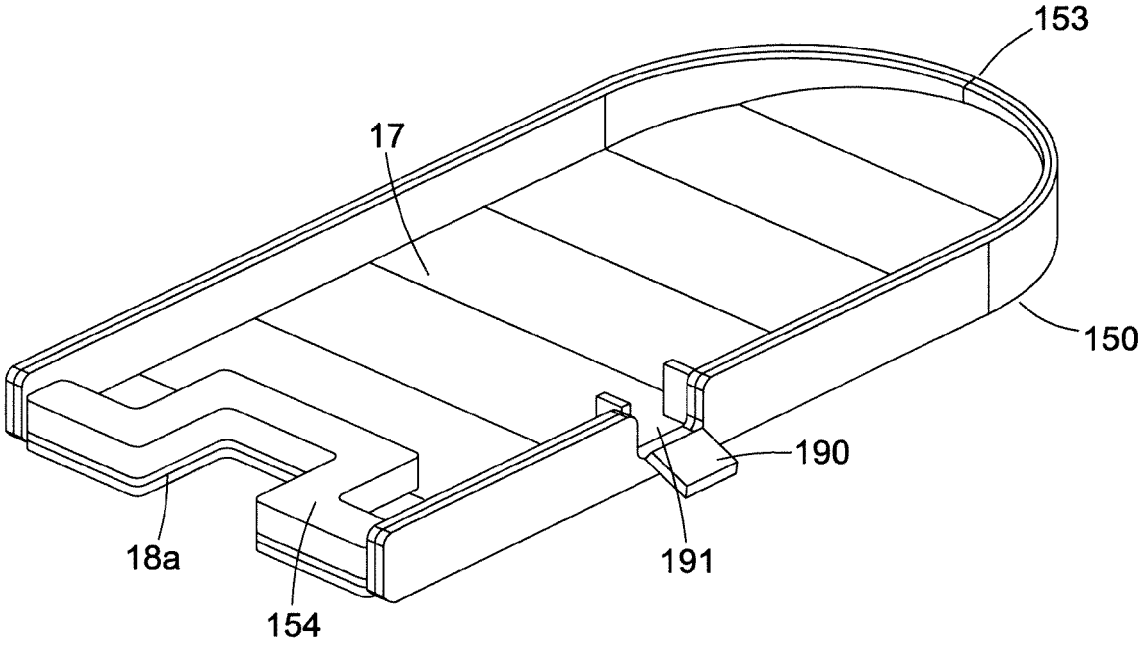
FIG. 19 is a perspective view of the hull including an opening and a door arrangement to assist in boarding persons from the water into the craft, along with the retrieval of casualties from the water.

Additionally, FIG. 19 shows a portion of the hull being arranged to serve as a door 190 allowing persons in the water to board the craft or assist in the retrieval of casualties from the water. The door 190 may be pivotally attached to the hull providing an opening 191. The opening and door arrangement maintains, as far as practical, the integrity of the hull.

The survival craft may be provided with a fire suppression system, such as a deluge pump for spaying water over the canopy in the event of a fire.

The survival craft may be provided with lighting. Such lighting may be configured to relive sea sickness. Lighting (e.g. LED lighting) may be provided in the floor to guide passengers to/from the exit/entrance.

The survival craft may be equipped with display screens for providing information to the passengers, such as safety information. The display screens may be foldable from a stowed position to a deployed position by a suitable mechanism.

The survival craft may be equipped with GPS navigation, radar and/or navigation lights.

The survival craft may be self-righting.

FIGS. 20 to 26 show an alternative construction of the survival craft.

Figure 20A:
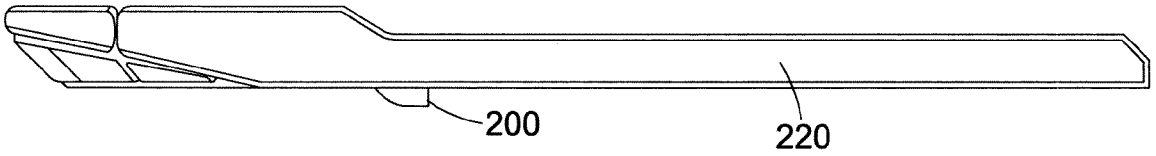
FIGS. 20A and 20B are, respectively, a side elevation and an overhead plan view of a craft in accordance with another embodiment of the invention.
Figure 20B:
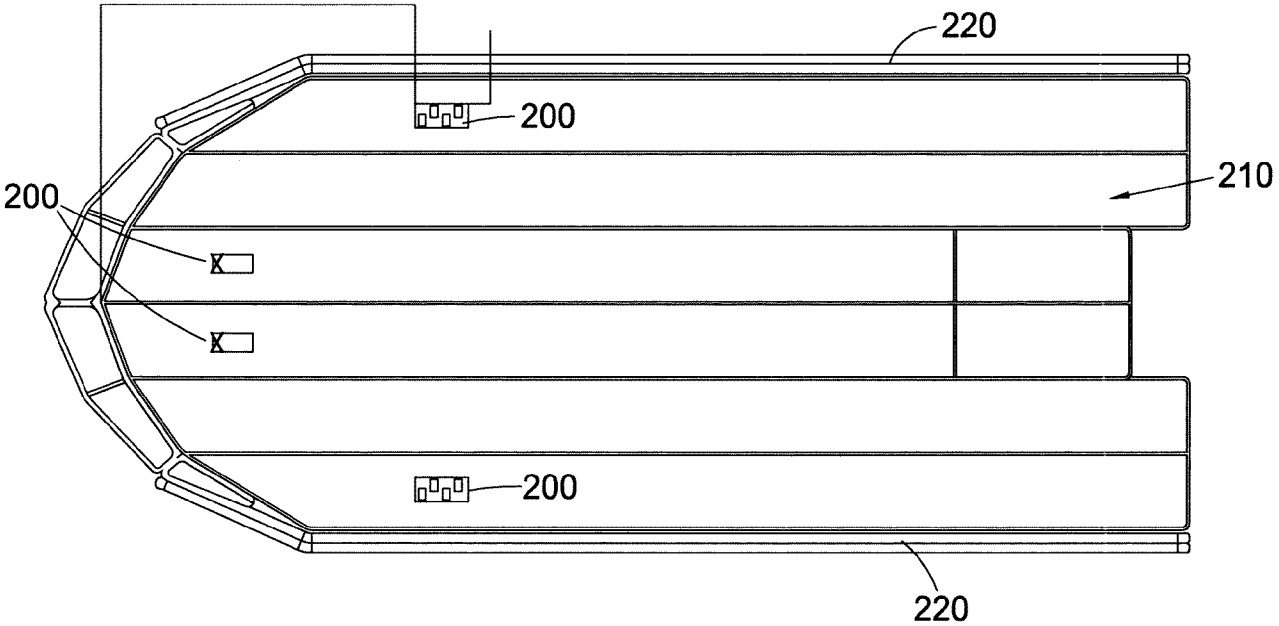

As shown in FIG. 20, the craft may be fitted with fins 200 to assist with the steering and control of the craft. These fins 200 may be fitted either on the underside of the hull 210 or dropped/lowered down from a sidewall 220. If dropped/lowered down from the sidewall 220, they may be a pair—one port, one starboard. If fins are fitted to the underside of the hull 210, they may be spaced evenly across the width of the hull 210 in the front. There may normally be in combinations of two or four fins 200. The fins 200 may be used with other configurations of craft.

The fin(s) 200 as described above will normally be fabricated from a rigid material. Alternatively, an inflatable version of the fin(s) 200 may be used—e.g. using a drop thread material.

The hull 210 may be constructed using drop stitch panels mounted vertically (substantially perpendicularly to the horizontal floor of the hull 210). This provides additional stiffness/rigidity to the structure, creating a series of spines 230—see FIG. 22. The vertical panels can either be in the central portion of the craft or can be the side walls 220 of the craft or combinations thereof.

These vertically mounted panels can be extended through the floor of the hull, and protrude a short distance (typically 150 mm) below the floor. These protrusions 240 may assist in the steering and control of the craft. They may be an alternative to the fins 200. The panels preferably extend below the hull in the forward ⅔ of the craft (at the bow end). Additionally, or alternatively, the side walls 220 may protrude a short distance (typically 150 mm) below the floor, as shown at 245.

Figure 21:
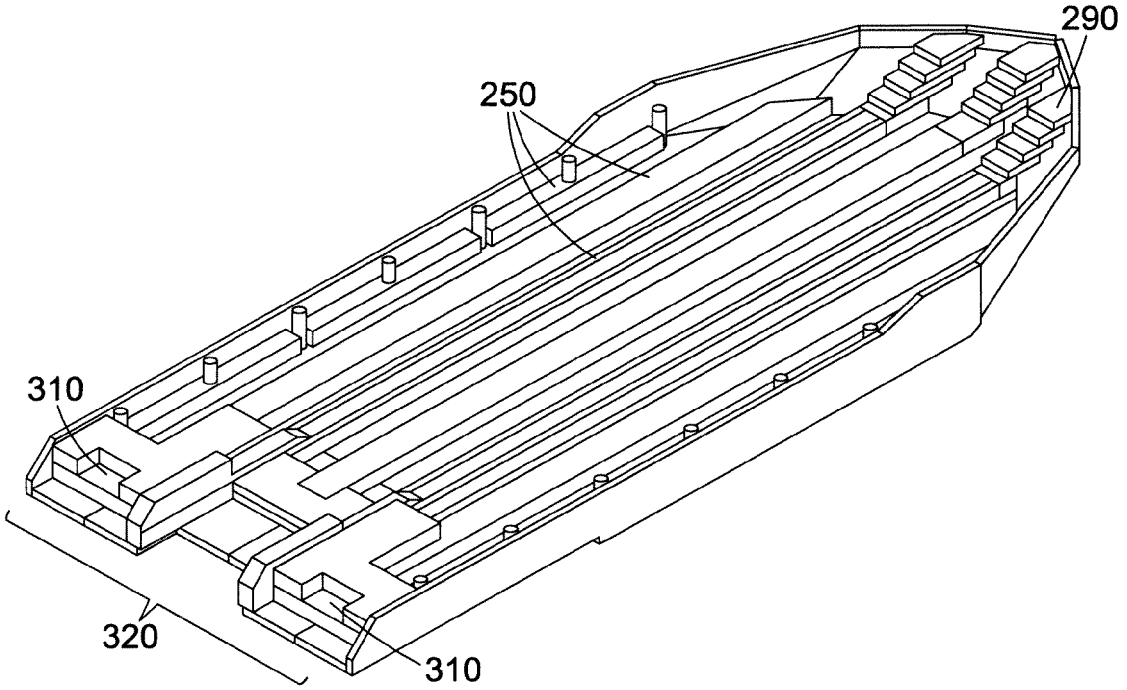
FIG. 21 is a perspective view of a modified survival craft showing the hull.
Figure 22:
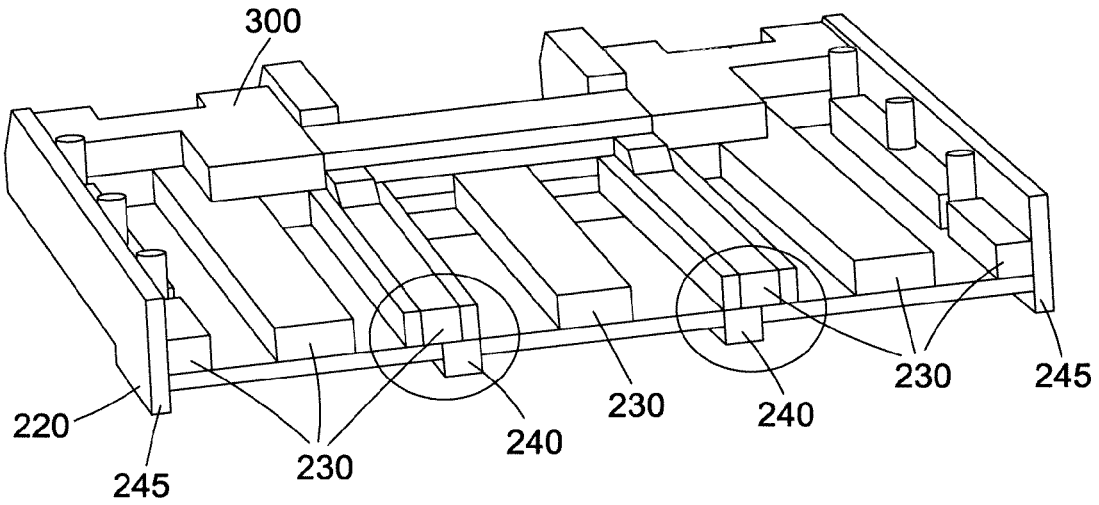
FIG. 22 is a parial perspective view of the stern of a modified survival craft.
Figure 23:
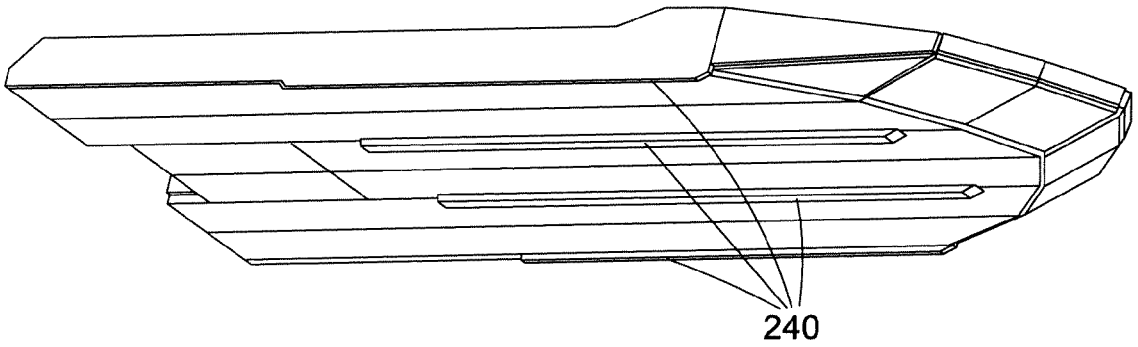
FIG. 23 is a perspective view of a modified survival craft showing underside of the hull.

The vertically mounted panels/spines 230 inside the craft side walls 220, can also be utilised for seating 250 inside the craft—see FIG. 21.

Additional seating can be provided inside the craft by using drop stitch panels mounted either vertically or horizontally. As well as providing seating, these panels will provide additional stiffness for the craft.

The seating arrangements can run either longitudinal along the craft or transverse across the craft.

Figure 24:
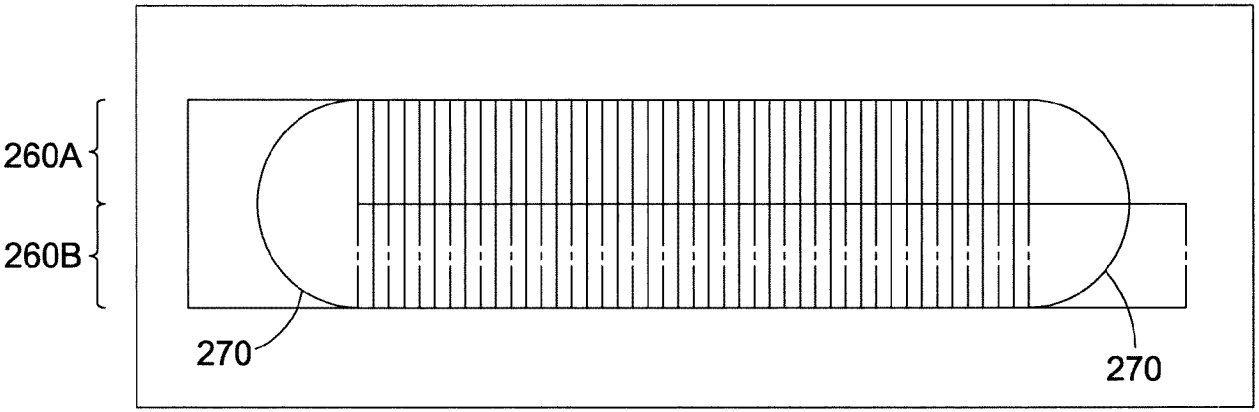
FIG. 24 shows schematically two joined drop thread panels.
Figure 25:
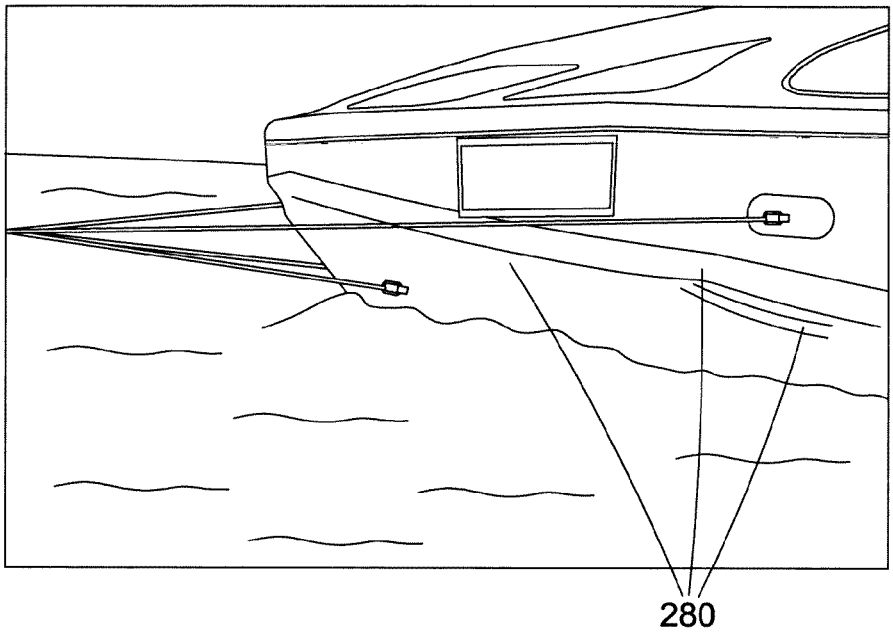
FIG. 25 shows a side elevation of the bow of a vessel the where butt ends of the drop stitch panels (that would otherwise extend perpendicularly to the direction of travel of the craft in water) are skinned to form a smooth surface.

The drop stitch panels can be assembled by a number of different methods. A fabric panel may be enclosed to make it air holding, and this is then joined to another air holding panel to form the required structure. Alternatively, the fabric panel can be joined to another fabric panel and then enclosed to make an air holding structure. The panels may include an end cap. FIG. 24 shows two joined drop stitch panels 260A and 260B with a shared end cap 270 at each end.

Figure 26:
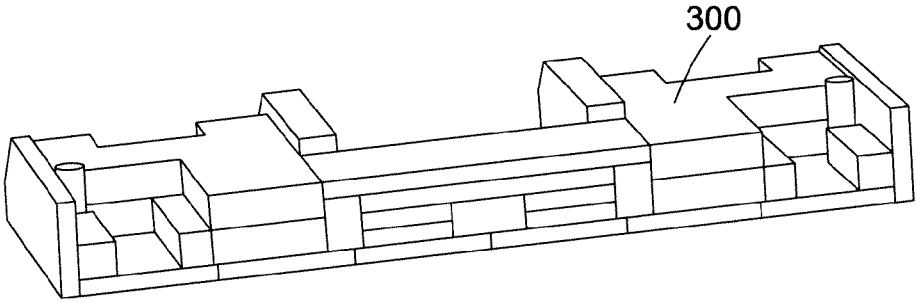
FIG. 26 is a partial perspective view of the stern of a modified survival craft showing the structure of the inflatable wall.

In certain key areas of the hull 210, in order to minimise drag, the butt ends of the drop stitch panels (that would otherwise extend perpendicularly to the direction of travel of the craft in water) are skinned to form a smooth surface as shown at 280 in FIG. 26. The skinned ends 280 typically would be at the bow and side wall areas.

In order to support the bow panels a stepped reinforcing arrangement 290 may be added to inside face of the bow. The stepped reinforcing arrangement 290 provides access to the bow windows of the craft to assist in steering and towing arrangements—see FIG. 21.

The construction of the inflatable transom wall area 300 may be such that it is laminate in structure allowing it to be reinforced by cross linking different panels—see particularly FIG. 26. Some of the panels may extend vertically and others may extend horizontally.

The rear area of the inflatable transom 300 may have cut outs 310 provided to allow easy access into the craft from the water—see particularly FIG. 21.

The rear area of the inflatable transom 300 may be extended as shown at 320 in FIG. 21 to have a sufficient length to protect the engines and the rigid pod from contacting the side shell of the vessel that the craft is deployed from.

The survival craft described above with reference to the drawings is more compact than rigid survival crafts and so occupies less space on a marine structure. This can be important on passenger ships where outside space to the sides of the ship is at a premium. At the same time, the survival craft has the advantage over unpowered inflatable life rafts that it is powered and steerable and so can be used to move persons clear of the marine structure.

"Drop thread" (also sometimes referred to as "drop stitch") material is made by weaving "three dimensionally" on a special loom. An outer and inner textile layer is woven in a conventional manner but the loom is able to weave threads vertically at 90° between the inner and outer layers of textile. These vertical threads are termed "drop threads".

The invention claimed is:

1. A survival craft including inflatable members, the survival craft comprising:

a hull formed from a plurality of the inflatable members and including a floor;

a rigid pod configured to carry, in a deflated state, the survival craft;

an inflatable wall formed from the of inflatable members for mounting the rigid pod to the hull, wherein:

the floor has a recess therein at a stern end thereof to provide an opening;

the inflatable wall surrounds the recess, the inflatable wall is configured to facilitate the application of motive power from a propulsion source to the hull to move the hull in water, and the rigid pod is coupled to the hull when the survival craft is in an inflated state.

2. A survival craft according to claim 1 wherein the rigid pod is securely attached to the wall by at least one of a fastening means and an interference fit.

3. A survival craft according to claim 1 wherein at least one powered propulsion unit is attached to the rigid pod.

4. A survival craft according to claim 3 wherein the at least one powered propulsion unit is attached to the rigid pod with a lowering mechanism.

5. A survival craft according to claim 3 wherein the rigid pod carries a source of energy for the at least one powered propulsion unit.

6. A survival craft according to claim 1 including a canopy support structure carried by the hull and formed from inflatable members.

7. A survival craft according to claim 1 wherein the rigid pod carries an inflation system for inflating the craft.

* * * * *